US005848874A

United States Patent [19]

Heumann et al.

[11] Patent Number: 5,848,874

[45] Date of Patent: Dec. 15, 1998

[54] GAS TURBINE STATOR VANE ASSEMBLY

[75] Inventors: David E. Heumann, Jupiter, Fla.; M. Stefan Maier, North Berwick, Me.

[73] Assignee: United Technologies Corporation, Hartford, Conn.

[21] Appl. No.: 855,082

[22] Filed: May 13, 1997

[51] Int. Cl.[6] ..... F01D 9/04

[52] U.S. Cl. ..... 415/189; 415/209.2; 415/209.3; 60/39.31; 411/24; 411/539

[58] Field of Search ..... 415/136, 138, 415/189, 190, 139, 209.2, 209.3, 209.4; 60/39.31, 39.32; 411/24, 26, 27, 28, 32, 33, 539

[56] References Cited

U.S. PATENT DOCUMENTS

| | | | |
|---|---|---|---|
| 2,872,227 | 2/1959 | Wachs | 411/24 |
| 2,971,425 | 2/1961 | Blakeley | 411/28 |
| 3,041,913 | 7/1962 | Liska | 411/539 |
| 3,072,423 | 1/1963 | Charlton | 411/539 |
| 3,373,648 | 3/1968 | Pitzer | 411/24 |
| 3,992,126 | 11/1976 | Brown et al. | 415/136 |
| 4,286,921 | 9/1981 | Donlan | 415/136 |
| 4,485,847 | 12/1984 | Wentzell | 411/24 |
| 4,684,320 | 8/1987 | Kunz | 415/190 |
| 4,688,378 | 8/1987 | Harris | 60/39.32 |
| 4,890,978 | 1/1990 | McLaurin et al. | 415/209.4 |
| 5,141,394 | 8/1992 | Donlan | 415/190 |
| 5,702,214 | 12/1997 | Duran | 411/24 |

*Primary Examiner*—Christopher Verdier
*Attorney, Agent, or Firm*—Richard D. Getz

[57] ABSTRACT

A stator vane assembly for a gas turbine engine includes a plurality of stator vane segments and fasteners. Each stator vane segment includes an inner radial platform, an outer radial platform, at least one airfoil extending between said platforms, and a first mounting flange extending radially outward from said outer radial platform. Each first mounting flange is aligned with a second mounting flange extending radially inward from an outer case surrounding the stator vane assembly. Each fastener includes a bolt extending through the first and second mounting flanges, a nut for threaded engagement with the bolt, and apparatus for preventing vibration of the fasteners.

4 Claims, 2 Drawing Sheets

GAS TURBINE STATOR VANE ASSEMBLY

The invention was made under a U.S. Government contract and the Government has rights herein.

BACKGROUND OF THE INVENTION

1. Technical Field

This invention applies to gas turbine engines in general, and to stator vane assemblies within gas turbine engines in particular.

2. Background Information

In a gas turbine engine, a turbine first stage stator vane assembly guides core gas flow exiting the combustor into the first stage rotor assembly. The first stage stator vane assembly is an annular structure consisting of a plurality of stator vane segments each of which includes an airfoil(s) extending between an inner and an outer radial platform. The airfoils guide core gas flow into the first stage rotor assembly in a direction designed to increase efficiency within the rotor assembly. Proper alignment between the stator vane segments and the combustor is critical to ensure a continuous core gas flow path between the combustor and the rotor.

Misalignment between the combustor and the stator vane segments can occur for a variety of reasons, such as warpage of the combustor, improperly mounted stator vane segments, or disparities in thermal growth. If the misalignment is significant, hot core gas can impinge on a radial and/or uncooled platform surface, and thereby increase the potential for thermal failure. The stator vane assembly must also be able to accommodate gas path loading on each of the stator vane segments. Gas path loading can cause stator vane segments to travel axially and/or rotate and consequently become misaligned.

In short, what is needed is a stator vane assembly which can be consistently mounted relative to a combustor and/or a rotor assembly, and one that facilitates mounting of the combustor relative to the stator vane assembly.

DISCLOSURE OF THE INVENTION

It is, therefore, an object of the present invention to provide a means for mounting a stator vane assembly relative to a combustor.

It is another object of the present invention to provide a stator vane assembly that can be readily assembled and mounted.

It is another object of the present invention to provide a stator vane assembly that maintains a continuous core gas flow path therethrough.

It is still another object of the present invention to provide a stator vane assembly that facilitates sealing between platforms of adjacent stator vane segments.

It is another object of the present invention to provide a stator vane assembly that can accommodate gas path loading and thermal growth within the engine while maintaining proper alignment between a combustor and an adjacent stator vane assembly.

According to the present invention, a stator vane assembly for a gas turbine engine is provided which includes a plurality of stator vane segments and fasteners. Each segment includes an inner radial platform, an outer radial platform, at least one airfoil extending between the platforms, and a first mounting flange extending radially outward from the outer radial platform. The stator vane segments collectively form an annular structure. The first mounting flange is aligned with a second mounting flange extending radially inward from an outer case surrounding the stator vane assembly. Each fastener is received within the first and second mounting flanges and each includes a bolt, a nut, and means for preventing vibration of the fastener.

According to one aspect of the present invention, a means for accommodating misalignment between stator vane segments and an adjacent combustor is provided.

An advantage of the present invention is that means for accurately mounting a stator vane assembly is provided. The present invention circumferentially locates each stator vane segment relative to the outer case and provides means for positively holding the combustor relative to the stator vanes. Locating each stator vane segment relative to the outer case helps minimize misalignment between adjacent stator vane segments. The ability of the present invention to secure the combustor in a particular position relative to the stator vane assembly helps minimize misalignment between the stator vane assembly and the combustor.

Another advantage of the present invention is that the stator vane assembly can be readily assembled and positioned relative to the outer case and the combustor. The stator vane segments and the combustor are attached to the outer case by fasteners extending through mounting flanges. Once a stator vane segment is attached to the outer case, the fasteners maintain the circumferential position of the segment and prevent it from becoming dislodged from the combustor such as might happen if the stator vane segment was not positively engaged with the aft end of the combustor.

Another advantage of the present invention is that vibrational wear is avoided by the means for preventing vibration of the fasteners relative to the mounting flanges.

Another advantage of the present invention is that cooling air leakage caused by misalignment is minimized. Cooling air leak paths can be created or increased by misalignment between, for example, adjacent stator vane segments. The present invention also helps prevent misalignment between adjacent stator vane segment platforms, and therefore cooling air leak paths created by such misalignment.

These and other objects, features, and advantages of the present invention will become apparent in light of the detailed description of the best mode embodiment thereof, as illustrated in the accompanying drawings.

BEST MODE FOR CARRYING OUT THE INVENTION

Figure 1:
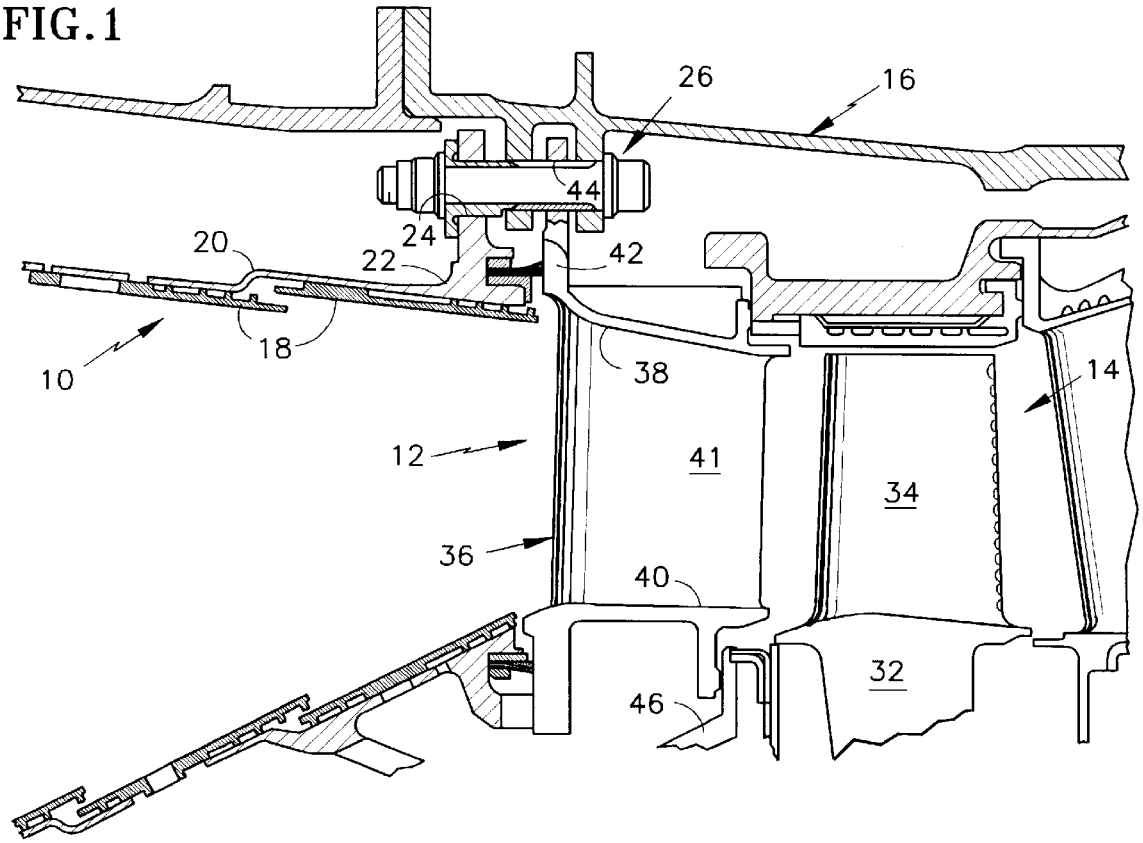
FIG. 1 is a diagrammatic view of a stator vane assembly disposed between the aft end of a combustor and a rotor assembly.
Figure 5:
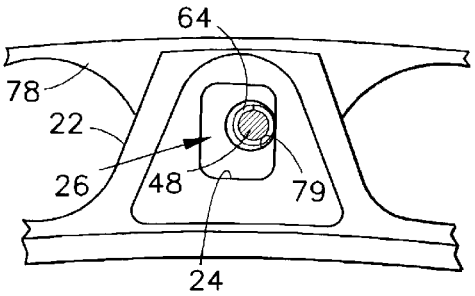
FIG. 5 is a diagrammatic sectional end view of a fastener and a split sleeve, shown slightly misaligned relative to a combustor mounting flange.
Figure 6:
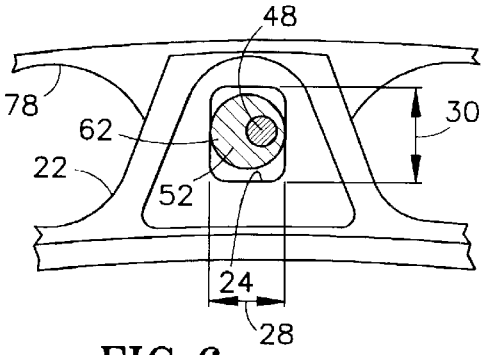
FIG. 6 is a diagrammatic sectional end view of a fastener and a cam sleeve, showing the cam sleeve accommodating the slight misalignment between the fastener and the combustor mounting flange.

Referring to FIG. 1, a gas turbine engine includes a combustor 10, a first stage stator vane assembly 12, and a first stage rotor 14 disposed radially inside of an outer case 16. The combustor 10 includes a plurality of liner segments 18 attached to an annular shell 20. A plurality of mounting flanges 22 extend radially outward from the annular shell 20, distributed around the circumference of the annular shell 20. Each combustor mounting flange 22 includes an aperture 24 for receiving a fastener 26. In the preferred embodiment, the aperture 24 (see FIGS. 5 and 6) is radially elongated, and may be described as having a circumferential width 28 and a radial length 30. The first stage rotor 14 includes a disk 32 rotatable around an axis and a plurality of rotor blades 34 distributed around the circumference of the disk 32.

The first stage stator vane assembly 12 is an annular structure formed from a plurality of stator vane segments 36. Each stator vane segment 36 includes an outer radial platform 38, an inner radial platform 40, and at least one airfoil 41 extending between the platforms 38,40. At least one mounting flange 42 extends radially outward from the outer radial platform 38 of each stator vane segment 36. Each mounting flange 42 includes an aperture 44 for receiving a fastener 26. An inner support ring 46 supports the inner radial platform 40 of each stator vane segment 36. Featherseals (not shown) extend between adjacent inner and outer platforms 38,40 of adjacent stator vane segments 36 to provide sealing therebetween.

Figure 2:
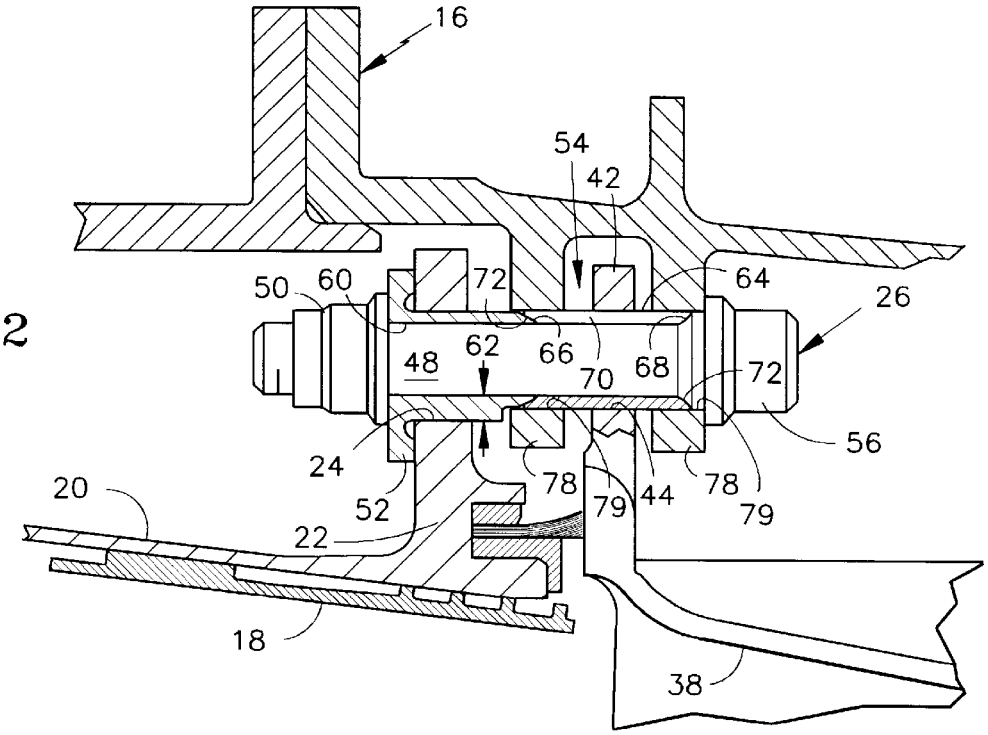
FIG. 2 is an enlarged partial view of the stator vane assembly shown in FIG. 1.
Figure 3:
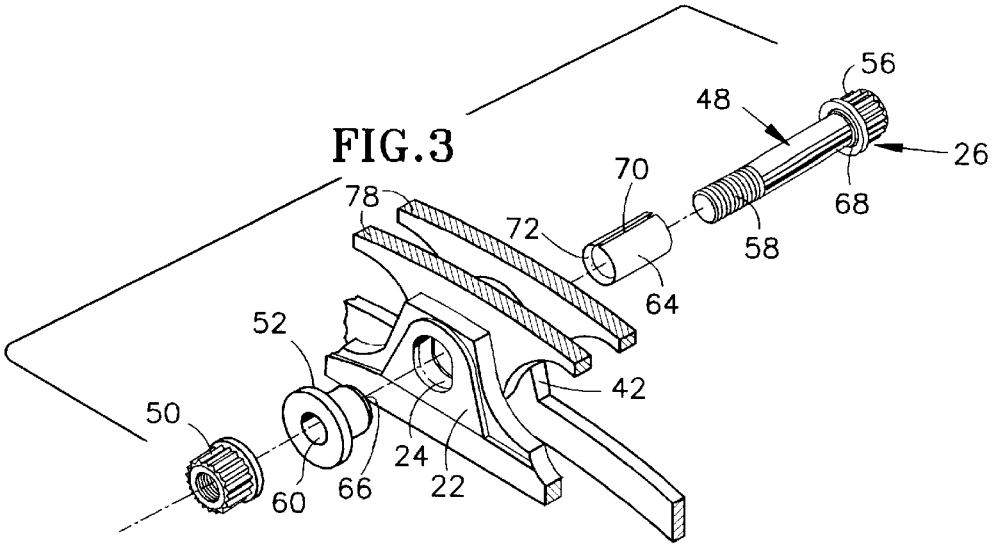
FIG. 3 is an exploded view of a fastener and mounting flanges.

Referring to FIGS. 2 and 3, the first stage stator vane assembly 12 further includes a plurality of fasteners 26. Each fastener 26 includes a bolt 48, a nut 50, a cam sleeve 52, and means 54 for preventing vibration of the fastener 26. The bolt 48 includes a head 56. The cam sleeve 52 includes an eccentrically located axial bore 60 (see also FIG. 6) that creates a cam lobe 62. In a first embodiment, the means 54 for preventing vibration of the fastener 26 includes a split sleeve 64, a first tapered surface 66 on an axial end of the cam sleeve 52, and a second tapered surface 68 adjacent the head 56 of the bolt 48. The split sleeve 64 has an axially extending break 70 (FIG. 3) and a tapered surface 72 on each axial end. The tapered surfaces 72 on each end of the split sleeve 64 are complementary with the tapered surfaces 66,68 of the bolt 48 and the cam sleeve 52, respectively. In a second embodiment (FIG. 4), the means 54 for preventing vibration of the fastener 26 includes a flanged sleeve 74 having an axial bore for receiving the bolt 48 and a contact surface 76 on the cam sleeve 52 in lieu of the first tapered surface 66. The contact surface 76 is substantially perpendicular to the axial bore of the cam sleeve 52.

Figure 4:
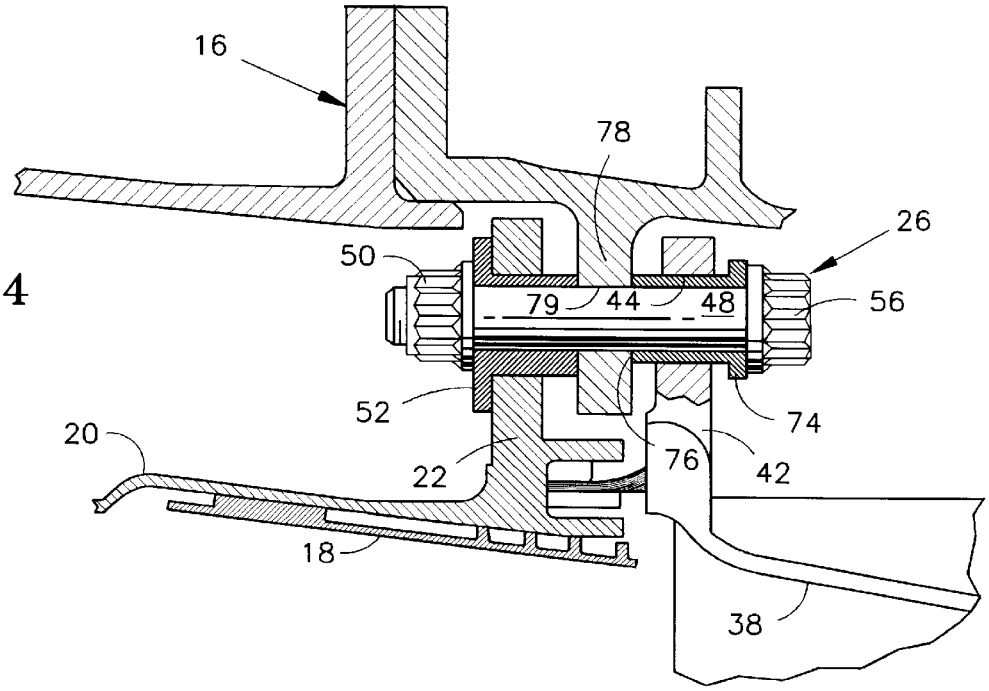
FIG. 4 is a diagrammatic view of a stator vane, combustor, and outer case connected to one another by a fastener.

Referring to FIGS. 1 and 4, an outer case 16 is disposed radially outside the combustor 10, the first stage stator vane assembly 12, and the first stage rotor assembly 14. In the embodiment shown in FIGS. 1 and 2, the outer case 16 includes a plurality of parallel mounting flanges 78 extending radially inward from the outer case 16, distributed around the circumference of the outer case 16. In the embodiment shown in FIG. 4, the outer case 16 includes a plurality of single mounting flanges 78 extending radially inward from the outer case 16, distributed around the circumference of the outer case 16. In each embodiment, the mounting flanges 78 include an aperture 79 for receiving a fastener 26.

During installation of the first stage stator vane assembly 12, each stator vane segment 36 is attached to the outer case 16 by at least one fastener 26 extending through the outer case mounting flanges 78 and the stator vane mounting flange 42. In the embodiment shown in FIGS. 1–3, each bolt 48 is received within a split sleeve 64. Each bolt and split sleeve 64 are, in turn, received within the mounting flanges 42,78 of a first stage stator vane segment 36 and the outer case 16. Gross alignment between the stator vane segments and the combustor is accomplished by extending the bolts through the mounting flanges 22 of the combustor. The preferred method is to use a jig (not shown) to "round" up the combustor 10 and then bring the combustor 10 together with the stator vane segments 36. Subsequent to gross alignment, each bolt 48 is inserted through one of the combustor mounting flanges 22 and a cam sleeve 52 is slid onto the bolt 48 with the first tapered end 66 facing the split sleeve 64. In the event of minor misalignment between the outer case mounting flanges 78 (and therefore the stator vane segments 36) and the combustor mounting flanges 22, the lobe 62 of the cam sleeve 52 is rotated until the cam sleeve 52 is received within the combustor mounting flange 22.

Tightening the nut 50 onto the bolt 48 drives the first 66 and second 68 tapered surfaces into engagement with the tapered surfaces 72 of the split sleeve 64. The engagement of the first 66 and second 68 tapered surfaces causes the split sleeve 64 to expand radially and become biased within the mounting flanges 42,78, thereby preventing vibration of the fastener 26. The split sleeve 64 enables the fastener 26 to become fixed without deflecting the parallel outer case mounting flanges 78 toward one another, as would happen if a bolt 48 and nut 50 were used exclusively. In addition, the split sleeve 64 permits tolerances between the bolt 48 and the apertures 44,79 which would be otherwise unacceptable because of, for example, susceptibility to vibration and vibrational wear. Tightening the nut 50 also biases the lobe 62 of cam sleeve 52 into contact with the combustor mounting flange 22, thereby helping to maintain the position of the combustor 10 relative to the stator vane assembly 12.

In the embodiment shown in FIG. 4, a bolt 48 and flanged sleeve 74 are inserted through the mounting flange 42 of a first stage stator vane segment 36. The bolt 48 extends further through the mounting flange 78 of the outer case 16. Gross alignment between the stator vane segments 36 and the combustor 10 is accomplished by extending the bolts 48 through the mounting flanges 22 of the combustor 10. As in the first embodiment, the preferred method is to use a jig (not shown) to "round" up the combustor 10 and then bring the combustor 10 together with the stator vane segments 36. Subsequent to gross alignment, a cam sleeve 52 is slid onto each bolt 48 and a nut 50 is attached. In the event of minor misalignment between the outer case mounting flanges 78 (and therefore the stator vane segments 36) and the combustor mounting flanges 22, the lobe 62 of the cam sleeve 52 is rotated until the cam sleeve 52 is received within the combustor mounting flange.

Tightening the nut 50 causes the flanged sleeve 74 (captured between the head 56 of the bolt 48 and the outer case mounting flange 78) and the cam sleeve 52 (captured between the nut 50 and the outer case flange 78 on the side opposite that of the flanged sleeve 74) to clamp the outer case mounting bracket 78, thereby preventing vibration of the fastener 26. Tightening the nut 50 also biases the lobe 62 of cam sleeve 52 into contact with the combustor mounting flange 22, thereby helping to maintain the position of the combustor 10 relative to the stator vane assembly 12. In both embodiments, the elongated radial length 30 of the apertures within the combustor mounting flanges 22 allow the combustor 10 to grow radially if necessary.

Although this invention has been shown and described with respect to the detailed embodiments thereof, it will be understood by those skilled in the art that various changes in form and detail thereof may be made without departing from the spirit and the scope of the invention. For example, both embodiments discussed heretofore have advocated using a cam sleeve 52. In the case of the first embodiment, however, it may be desirable to omit using a sleeve with a concentric bore (rather than an eccentric bore) and still use the split sleeve 64 means for preventing vibration of the fastener 26. The present invention has been described in the "Best Mode" section herein using the first stage stator vane assembly 12, and its relationship to the combustor 10 as an example. The present invention may also be used in other applications where it is desirable to align adjacent stator vane segments, and/or between a stator vane assembly and adjacent liner assemblies.

We claim:

1. A stator vane assembly for a gas turbine engine, comprising:

a plurality of stator vane segments, each segment having an inner radial platform, an outer radial platform, at least one airfoil extending between said platforms, and a first mounting flange extending radially outward from said outer radial platform, said stator vane segments collectively forming an annular structure;

wherein each said first mounting flange is aligned with a second mounting flange extending radially inward from an outer case surrounding said stator vane assembly;

a plurality of fasteners, each said fastener including a bolt extending through said first and second mounting flanges, a nut for threaded engagement with said bolt, a flanged sleeve, and a cam sleeve having an eccentric axial bore;

wherein each said bolt is received within said flanged sleeve and said flanged sleeve is received within said first mounting flange, and said cam sleeve is received on said bolt; and wherein a third mounting flange extends radially upward from an annular combustor; and said cam sleeve is received within an aperture within said third mounting flange, and said cam sleeve and said flanged sleeve are on opposite sides of said second mounting flange; and wherein threading said nut onto said bolt causes said cam sleeve and said flanged sleeve to clamp said second mounting flange.

2. A stator vane assembly according to claim 1, wherein said aperture within said third mounting flange is radially elongated, having a circumferential width and a radial length;

wherein said cam sleeve rotates to accommodate misalignment between said bolt and said third flange.

3. A stator vane assembly for a gas turbine engine, comprising:

a plurality of stator vane segments, each segment having an inner radial platform, an outer radial platform, at least one airfoil extending between said platforms, and a first mounting flange extending radially outward from said outer radial platform, said stator vane segments collectively forming an annular structure;

wherein each said first mounting flange is aligned with a second mounting flange extending radially inward from an outer case surrounding said stator vane assembly;

a plurality of fasteners, each said fastener including a split sleeve having an axially extending break and tapered axial ends, a bolt having a head and a first tapered surface adjacent said head, and a nut for threaded engagement with said bolt, wherein each said bolt is received within said split sleeve and said split sleeve is received within said first and second mounting flanges;

a cam sleeve, having an eccentric axial bore for receiving said bolt and a second tapered surface, extending out from an axial end of said cam sleeve;

wherein said first and second tapered surfaces are substantially complimentary with said tapered axial ends of said split sleeve; and wherein threading said nut onto said bolt causes said first and second tapered surfaces to engage said tapered axial ends and expand said split sleeve into contact with said first and second mounting flanges; and wherein a third mounting flange extends radially upward from an annular combustor, and said bolt and said cam sleeve are received within an aperture within said third mounting flange.

4. A stator vane assembly according to claim 3, wherein said aperture within said third mounting flange is radially elongated, having a circumferential width and a radial length;

wherein said cam sleeve rotates to accommodate misalignment between said bolt and said third flange.

* * * * *